US007883741B2

(12) United States Patent
Antoine et al.

(10) Patent No.: US 7,883,741 B2
(45) Date of Patent: Feb. 8, 2011

(54) METHOD OF MANUFACTURING A BITUMINOUS COATED MATERIAL

(75) Inventors: Jean-Pierre Antoine, Francheville (FR); François Olard, Lyons (FR); Patrick Huon, Meyrie (FR)

(73) Assignee: LEA-CO International, Nozay (FR)

( * ) Notice: Subject to any disclaimer, the term of this patent is extended or adjusted under 35 U.S.C. 154(b) by 868 days.

(21) Appl. No.: 11/397,742

(22) Filed: Apr. 5, 2006

(65) Prior Publication Data

US 2006/0236614 A1 Oct. 26, 2006

(30) Foreign Application Priority Data

Apr. 8, 2005 (FR) ..... 05 03527

(51) Int. Cl.
*B05D 7/00* (2006.01)

(52) U.S. Cl. ..... 427/212; 427/215

(58) Field of Classification Search ..... 427/212, 427/215

See application file for complete search history.

(56) References Cited

U.S. PATENT DOCUMENTS 2,104,410 A * 1/1938 Baskin ..... 106/280
3,986,889 A * 10/1976 Muntzer et al. ..... 106/283
7,114,843 B2 * 10/2006 Romier et al. ..... 366/4
2005/0018530 A1 * 1/2005 Romier et al. ..... 366/7

FOREIGN PATENT DOCUMENTS

EP 1 469 038 A1 10/2004
FR 1 004 479 3/1952
FR 2479299 * 3/1981
FR 2 678 653 1/1993

OTHER PUBLICATIONS

Koenitzner, FR2479299 (machine translation).*
Translation of FR 2479299, Mar. 1981.*
U.S. Appl. No. 11/397,724, filed Apr. 5, 2006, Antoine, et al.

* cited by examiner

*Primary Examiner*—Michael Cleveland
*Assistant Examiner*—Robert Vetere
(74) *Attorney, Agent, or Firm*—Oblon, Spivak, McClelland, Maier & Neustadt, L.L.P.

(57) ABSTRACT

The method comprises a stage of drying of the granular materials followed by a stage of coating of the whole thereof with a hot bituminous binder.

According to the invention, the drying stage is carried out in conditions which allow a fraction of the initial humidity of the granular materials to remain.

The invention has application in road building.

12 Claims, No Drawings

METHOD OF MANUFACTURING A BITUMINOUS COATED MATERIAL

BACKGROUND

1. Field of the Invention

The invention relates to a method of manufacturing a coated material comprising solid fragments coated with a binder, the method comprising a stage of drying of the solid fragments followed by a stage of coating of the entirety of the solid fragments with binder, in particular with hot binder.

"Solid fragments" is taken to mean all solid fragments usable for forming coated materials in particular for road building, comprising in particular natural mineral granular materials and aggregates of coated materials resulting from the recycling of materials recovered from the repairing of roads.

"Binder" is taken to mean any hydrocarbon binder of fossil or vegetable origin which is usable for the formation of coated materials, in particular pure bitumen or bitumen with fluxing agents and/or liquefying agents added and/or bitumen modified by the addition of polymers, this binder being possibly presented in the form of an emulsion or foam.

2. Description of the Related Art

In the conventional method for hot coating, the drying stage is carried out so as to eliminate substantially entirely the humidity in the granular materials, which requires a considerable expense of energy clue to the large quantity of water initially contained in the granular materials. Moreover, the drying and increase in temperature bring about the release of vapours containing steam charged with dusts. Taking into account their large quantity, these vapours are difficult to process and the application of the method therefore leads to substantial pollution of the environment.

To solve this problem, EP 1 469 038 proposes to apply the drying stage to a first part of the granular materials, substantially devoid of fines, then to coat this first part with hot bitumen, and then to add to the mix thus obtained a second part of the granular materials comprising sands and fines.

This method requires two fractions of granular materials to be available, one devoid of fines and the other containing fines, which may lead to problems. Moreover, this method cannot be put into practice efficiently in certain existing coating installations, and may therefore necessitate costly adaptation thereof.

SUMMARY OF THE INVENTION

The object of the invention is to eliminate all or some of the above disadvantages.

The invention aims in particular at a method of the type defined in the introduction and provides that the drying stage is carried out in conditions which allow a fraction of the initial humidity to remain in the solid fragments.

Optional, additional or alternative features of the invention are given below:

- The drying stage only affects a first part of the solid fragments, which is then mixed, before the coating stage, to the remaining part which has retained its initial humidity.
- The drying stage is carried out at a temperature higher than 100° C., preferably at a temperature of about 130° C.
- The upper limit of the grain size of the remaining part is lower than, equal to or higher than the upper limit of the grain size of the first part.

- The upper limit of the grain size of the remaining part is lower than or equal to the lower limit of the grain size of the first part.
- The grain size of the remaining part is selected from 0/2 and 0/4.
- The drying stage applies to the entirety of the solid fragments and is carried out in conditions which allow a fraction of the humidity thereof to remain.
- The drying stage is carried out at a temperature lower than 100° C., preferably at a temperature of about 90° C.
- A controlled quantity of water is added to the solid fragments between the stages of drying and coating and/or after the coating stage.
- The binder is applied at a temperature of between 100 and 200° C., preferably of about 160° C., or between 30 and 90° C. in the case of a binder in the form of an emulsion.

In a modification of the method according to the invention the drying stage is applied only to a first part of the solid fragments, which is then coated, then the remaining part having retained its initial humidity is added to the mix obtained, at least the first part containing fines.

DETAILED DESCRIPTION OF THE PREFERRED EMBODIMENTS

The invention is illustrated below by examples. In these examples, the solid fragments are mineral granular materials having a grain size of 0/10 mm, the binder is bitumen with a penetrability of 35/50 according to the standard NF EN 1426, and drying is carried out at 130° C. when it is applied to only a first part of the granular materials and at 90° C. when it is applied to the entirety of the granular materials. The proportions indicated are by mass.

EXAMPLE 1

The solid fragments are formed of 98% granular materials having a grain size of 0/10 mm and of 2% calcareous fines. The 98% of 0/10 granular materials are formed of porphyry and have the following grain size distribution:

| | |
|---|---|
| 6/10 | 44 |
| 2/6 | 22 |
| 0/2 | 32. |

The 6/10 and 2/6 fractions and fines are mixed and dried at 130° C., then the 0/2 fraction is added at ambient temperature, its degree of humidity being 4%. Then 5.6% 35/50 bitumen is added at 160° C. to carry out coating.

EXAMPLE 2

The composition of solid fragments and the quantity of binder are the same as in Example 1.

Drying is carried out on the entirety of the solid fragments, whereupon 1.5% water is added in proportion by mass before carrying out coating by adding binder at 160° C.

EXAMPLE 3

The type and distribution of grain sizes of the solid fragments and the quantity of binder are the same as in Examples 1 and 2.

The entirety of the solid fragments is divided homogeneously into a first part representing 65% by mass and a second part representing 35% by mass. The first part is dried at 130° C., then the second part is added at ambient temperature, its degree of humidity being 4%. Then 5.6% 35/50 bitumen is added at 160° C. in order to carry out coating.

EXAMPLE 4

The type and grain size distribution of the solid fragments and the quantity of binder are the same as in Examples 1, 2 and 3.

The entirety of solid fragments is divided in a homogenous manner into a first part representing 80% by mass and a second part representing 20% by mass. Drying is carried out on the first part, which is then coated with the binder added at 160° C., whereupon the second part is added which is at ambient temperature and which has a degree of humidity of 4%.

EXAMPLE 5

In this example, the solid fragments are composed by mass of 2% calcareous fines, as in the previous examples, and of 98% siliceous limestone granules with a grain size of 0/10 mm, the grain size distribution of these being the following:

| | |
|---|---|
| 6/10 | 29 |
| 4/6 | 28 |
| 0/4 | 41. |

The procedure is as for Example 3, except that the two parts of the solid fragments do not have the same grain size composition, the first part comprising the entirety of the 6/10 and 4/6 fractions and fines and a proportion of the 0/4 fraction corresponding to 16% of the total of solid fragments, and the second part being formed of the remaining 25% of the 0/4 fraction, having a degree of humidity of 4%. Furthermore, the quantity of binder is brought to 5.9% of the mass of the solid fragments.

The table below gives for each of these examples the final temperature of the coated material and various properties thereof. By way of comparison, the corresponding data are supplied for reference coated materials obtained from the same components by the conventional method consisting of drying the entirety of the solid fragments at 160° C. before coating.

| | Example | | | | |
|---|---|---|---|---|---|
| | 1 | 2 | 3 | 4 | Reference |
| Final T (° C.) | ≈85 | ≈90 | ≈85 | ≈90 | 160 |
| PCG temp. | 95 | 95 | 95 | 95 | 160 |
| PCG % | 7.1 | 6.8 | 7.1 | 8.8 | 9.3 |
| % water | 0.3 | 0.3 | 0.4 | 0.2 | — |
| % voids | 5.7 | 7.4 | 9.2 | 7.4 | 6.2 |
| Rutting | 6.4 | 9.6 | 6.2 | 5.2 | 6.4 |
| r/R | 0.84 | 0.81 | 0.80 | 0.82 | 0.90 |

| | Example | |
|---|---|---|
| | 5 | Reference |
| Final T (° C.) | ≈90 | 160 |
| PCG temperature | 95 | 160 |
| PCG % | 9.9 | 10.8 |
| % water | 0.1 | — |
| % voids | 8.0 | 5.8 |
| Rutting | 5.7 | 6.4 |
| r/R | 0.70 | 0.88 |

In the table:

"PCG Temperature" represents the temperature in ° C. to which the coated material is brought in order to carry out the PCG test according to the French Standard P 98-252, "PCT %" represents the percentage of voids obtained for 60 gyrations during the test with the gyratory shearing press (PCG) according to the French Standard P 98-252, "% water" represents the content of water by mass of the coated material after coating, "% voids" represents the initial percentage of voids of the test piece subjected to the rutting test, "rutting" represents the percentage of voids after 30,000 cycles during the rutting test according to the French Standard P 98-253-1, "r/R" represents the ratio r/R obtained during the Duriez test according to French Standard P 98-251-1.

We claim:

1. A method of manufacturing a coated material comprising solid fragments coated with a binder, the method consisting of:

preparing dried solid fragments; and coating the dried solid fragments with a liquid bituminous binder to obtain coated solid fragments;

wherein:

preparing the dried solid fragments comprises drying under conditions that permit the solid fragments to retain a fraction of their initial humidity; and coating the dried solid fragments comprises coating under conditions that permit the coated solid fragments to retain some residual humidity.

2. The method according to claim 1, wherein preparing the dried solid fragments comprises:

drying a first part of the solid fragments;

obtaining a second part of the solid fragments retaining its original humidity; and mixing first part and the second part to obtain the dried solid fragments.

3. The method according to claim 2, wherein preparing the dried solid fragments comprises drying at a temperature higher than 100° C.

4. The method according to claim 2, wherein preparing the dried solid fragments comprises drying at a temperature of about 130° C.

5. The method according to claim 1, wherein preparing the dried solid fragments comprises drying all of the solid fragments.

6. The method according to claim 5, wherein drying all of the solid fragments comprises drying at a temperature lower than 100° C.

7. The method according to claim 5, wherein drying all of the solid fragments comprises drying at a temperature of about 90° C.

8. The method according to claim 1, wherein preparing the dried solid fragments comprises adding a controlled quantity of water the solid fragments.

9. The method according to claim 1, wherein the binder is of fossil or vegetable origin.

10. The method according to claim 1, wherein coating the dried solid fragments comprises applying the binder at a temperature of between 100 and 200° C.

11. The method according to claim 1, wherein coating the dried solid fragments comprises applying the binder at a temperature of about 160° C.

12. The method according to claim 1, wherein:

the binder is in the form of an emulsion; and coating the dried solid fragments comprises applying the binder at a temperature of between 30 and 90° C.

* * * * *